US011495093B2

(12) United States Patent
Rodd

(10) Patent No.: US 11,495,093 B2
(45) Date of Patent: Nov. 8, 2022

(54) POKER GAME SYSTEM AND METHOD INVOLVING PRE-FLOP FOLD OR FIXED BET OPTION

(71) Applicant: Roger Rodd, North Hollywood, CA (US)

(72) Inventor: Roger Rodd, North Hollywood, CA (US)

( * ) Notice: Subject to any disclaimer, the term of this patent is extended or adjusted under 35 U.S.C. 154(b) by 0 days.

(21) Appl. No.: 17/209,991

(22) Filed: Mar. 23, 2021

(65) Prior Publication Data

US 2022/0309881 A1 Sep. 29, 2022

(51) Int. Cl.
*G07F 17/32* (2006.01)

(52) U.S. Cl.
CPC ..... *G07F 17/3293* (2013.01); *G07F 17/322* (2013.01); *G07F 17/3267* (2013.01)

(58) Field of Classification Search
USPC ..... 463/13, 12, 11
See application file for complete search history.

(56) References Cited

U.S. PATENT DOCUMENTS

2008/0182644 A1* 7/2008 Lutnick ..... G07F 17/3244 463/20
2011/0065490 A1* 3/2011 Lutnick ..... G07F 17/3223 463/16
2011/0102372 A1* 5/2011 Han ..... G06F 3/0425 345/175
2017/0124810 A1* 5/2017 Fraser ..... G07F 17/3293
2018/0047255 A1* 2/2018 Yee ..... G07F 17/3211

* cited by examiner

*Primary Examiner* — Pierre E Elisca
(74) *Attorney, Agent, or Firm* — FisherBroyles, LLP; Rob L. Phillips

(57) ABSTRACT

A poker game system and method involving hole cards and community cards such as Texas Hold'em, Omaha and Stud. The system and method replace pre-flop betting with an option to fold or place a fixed bet with no permitted raises. The system and method serve to increase the number of players electing to play the initial round of community cards (e.g., the flop in Texas Hold'em).

6 Claims, 5 Drawing Sheets

POKER GAME SYSTEM AND METHOD INVOLVING PRE-FLOP FOLD OR FIXED BET OPTION

FIELD OF THE INVENTION

The embodiments of the present invention relate to a poker game system and method whereby a pre-flop betting round, including the option to check, bet/raise or fold is replaced with the option to fold or place a fixed bet only.

BACKGROUND

Poker became very popular in the 2000s due to various factors including amateur Chris Moneymaker winning the World Series of Poker, televised poker and online poker. Television served to raise poker awareness, the Internet provided immediate access to poker games and Moneymaker showed that anyone could win. As a result, brick and mortar poker rooms and online poker rooms were full. Poker has since leveled off in popularity well below the peak levels experienced in the 2000s. Many factors may account for the dip in popularity but one reason is the small number of hands players play to conclusion during a session.

For example, in Texas Hold'em, many hands end pre-flop before any community cards are dealt. Thus, the hand ends after the players have seen only 2 of a possible 7 cards. The poker hands typically end quickly because one player raises the pot beyond what the other players are willing to invest with marginal or weak starting hands.

Thus, it would be advantageous to develop a poker game system and method whereby more players participate in the hand until at least a first set of community cards are dealt and a first betting round begins.

SUMMARY

The embodiments of the present invention relate primarily to poker games involving hole cards and community cards. Such games including Texas Hold'em and Omaha. Stud and other poker games may benefit from the embodiments of the present invention as well. In broad terms, the embodiments of the present invention involve a poker game system wherein pre-flop betting is replaced with an option to fold or place a fixed bet with no permitted raises.

One Texas Hold'em or Omaha embodiment of the present invention relates to a game system comprising: a poker table configured to accommodate nine or more players and a dealer; an automatic card shuffler integrated into said poker table; a chip rack, containing gaming chips, integrated into said poker table; a standard deck of playing cards and wherein said dealer is instructed to: (i) deal each player one or more hole cards; (ii) bury said hole cards from each player electing to fold; (iii) accept a fixed bet from each player electing to participant in the hand; (iv) reveal one or more community cards; (v) conduct a betting round; (vi) repeat steps (iv) and (v) until all community cards have been revealed; (vii) determine a winning hand and (viii) award a pot to a player holding said winning hand.

One Stud embodiment of the present invention relates to a game system comprising: a poker table configured to accommodate nine or more players and a dealer; an automatic card shuffler integrated into said poker table; a chip rack, containing gaming chips, integrated into said poker table; and wherein said dealer is instructed to: (i) deal each player one or more hole cards; (ii) bury said hole cards from each player electing to fold; (iii) accept a fixed bet from each player electing to participate in the hand; (iv) deal each player one or more face-up cards; (v) conduct a betting round; (vi) repeat steps (iv) and (v) until all face-up cards have been revealed; (vii) deal each player a final face-down card; (viii) conduct a final betting round; (ix) determine a winning hand and (x) award a pot to a player holding said winning hand.

The embodiments of the present invention may be used with live poker games (cash or tournament) conducted at physical poker tables, online, within a local area network or other digital, virtual and electronic media.

Other variations, embodiments and features of the present invention will become evident from the following detailed description, drawings and claims.

DETAILED DESCRIPTION

Figure 1:
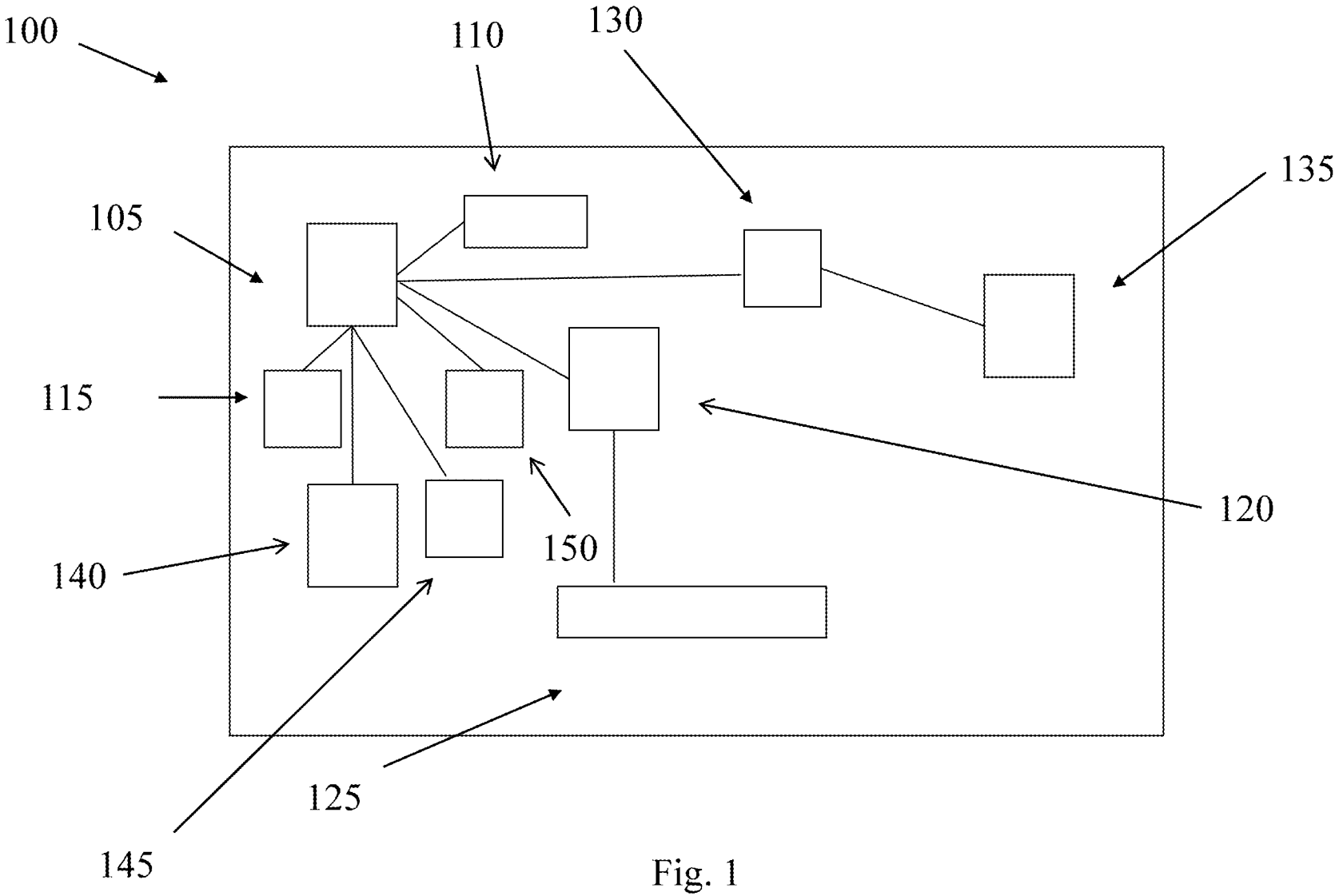
FIG. 1 illustrates a block diagram of an electronic gaming machine of the type which may facilitate electronic embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the virtual, digital and online embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" and "gaming machine" should be understood to be any one of a general purpose computer, as for example a personal computer or a laptop computer, a client computer configured for interaction with a server, a special purpose computer such as a server, or a smart phone, tablet computer, personal digital assistant or any other machine adapted for executing programmable instructions in accordance with the description thereof set forth herein.

In addition to live poker rooms where the disclosed poker game system is installed and poker game is played, the embodiments of the present invention may be facilitated by a mobile, electronic gaming device network, whereby multiple players play against one another under the control of a central game server as described herein. Also, besides mobile electronic devices, multiple electronic gaming devices in the form of standalone gaming devices/machines and/or bar-top devices/machines may form a gaming device/machine network for conducting a game according to the embodiments of the present invention. In one embodiment, a poker table incorporates player interfaces at each player position such that players may play at a physical poker table using the player interfaces.

A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 which are generally permanent. CPU 105 may be connected to a video controller 120 which provides output to one or more video displays 125. Similarly, an audio controller 130 provides audio output as dictated by the CPU 105 through speakers 135. The components listed above, and others, may be attached to a circuit board forming a motherboard. In another embodiment, the electronic gaming device 100 may be linked to a central game server which allows players to select from a plurality of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Bet memory 145 stores an amount of money/credits deposited into the electronic gaming device 100 by a player and specific bet information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
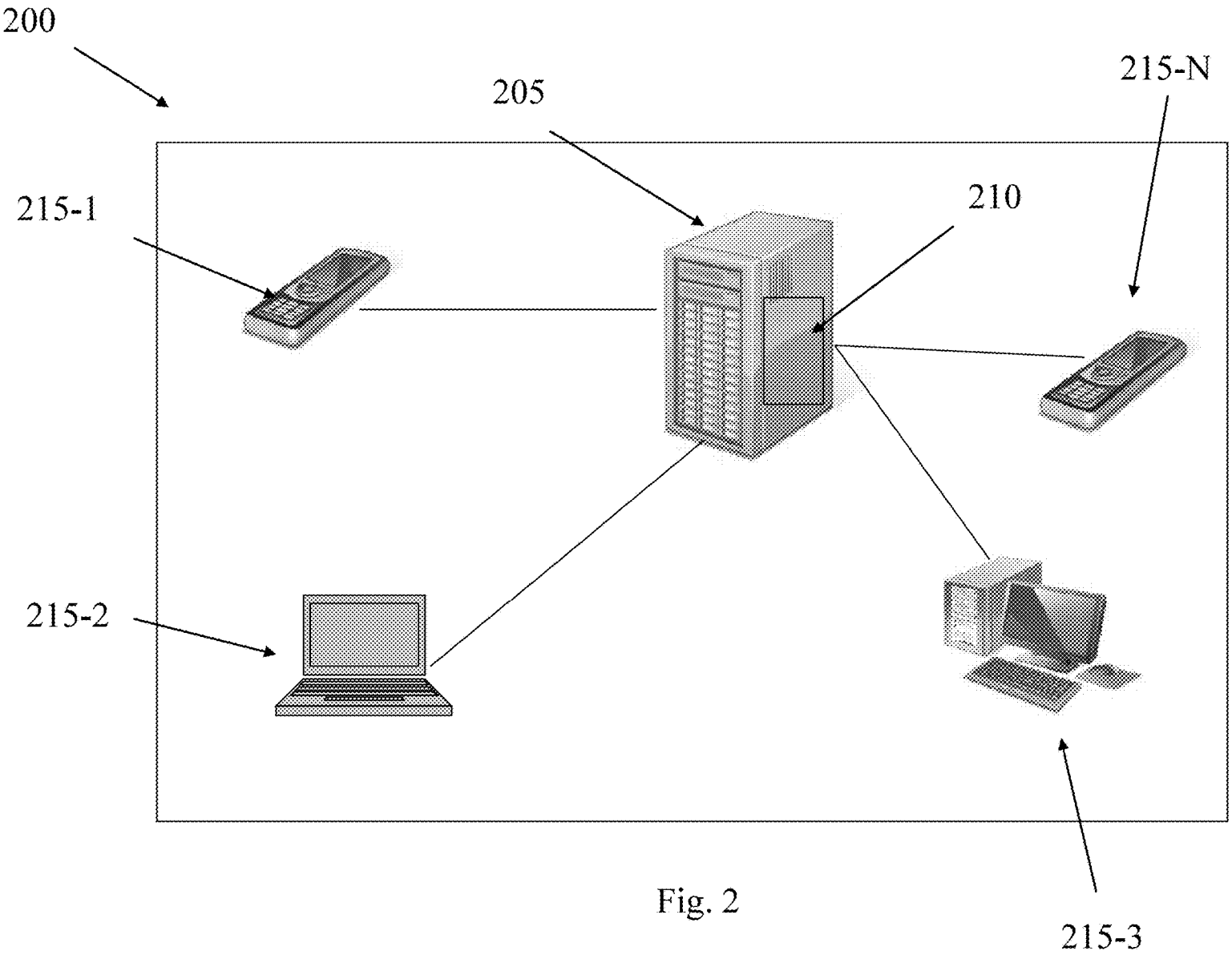
FIG. 2 illustrates a block diagram of a wireless mobile device network which may form part of poker game system according to the embodiments of the present invention.

FIG. 2 shows a block diagram of a wireless mobile device network 200 which may be used to facilitate remote play of the poker game according to the embodiments of the present invention. With this embodiment, a software application ("App") is downloaded to smart phones or tablets and playable via processing power and a user interface associated therewith. The wireless network 200 comprises a game server 205, including one or more processors 210 running poker game software, and remote smart devices 215-1 through 215-N (e.g., smart phones) configured to access said game server 205 facilitating game play on the remote devices 215-1 through 215-N. Players play the game using the touchscreen associated with the remote devices 215-1 through 215-N.

For purposes of this detailed description, Texas Hold'em is used as the exemplary poker game system to describe the embodiments of the present invention. The embodiments of the present may be utilized with limit, no limit and pot limit variations of the subject poker game and may be utilized in cash games or tournaments. Conventionally, Texas Hold'em is played as follows: (i) a player is designated as the dealer; (ii) the first player to the left of the designated dealer places a small blind bet and the player to the left of the small blind places a large blind bet; (iii) each player is dealt two hole cards (i.e., face down player's cards) one card at a time in a clockwise fashion starting with the small blind; (iv) a first betting round occurs during which players may check, bet/raise and/or fold; (v) three community cards (flop) are revealed; (vi) a second betting round occurs during which players may check, bet/raise and/or fold; (vii) a fourth community card (turn) is revealed; (viii) a third betting round occurs during which players may check, bet/raise and/or fold; (ix) a fifth and final community card (river) is revealed; (x) a fourth betting round occurs during which players may check, bet/raise and/or fold; (xi) a five-card winning poker hand is determined using the best five cards in each player's hand based on the two hole cards and five community cards and (xii) the pot is awarded to the player holding the winning (i.e., highest ranking) five-card poker hand. Often, a hand of Texas Hold'em ends prior to any community cards being revealed because one player raises pre-flop forcing all other players to fold before observing any flop cards. The quick conclusion of poker hands is one aspect of Texas Hold'em and other poker games that can be discouraging for players.

The embodiments of the present invention relate to the first betting round prior to the flop cards being revealed. The objective of the embodiments of the present invention is to keep more players in the hand to observe the flop cards. After the flop cards have been revealed, the players in the hand have now seen five (i.e., two-hole cards and three flop cards) of the available seven cards. After observing five cards, players have a much better sense of the value of their hand and are more likely to call or bet/raise creating larger pots to the benefit of players and the house.

Figure 3:
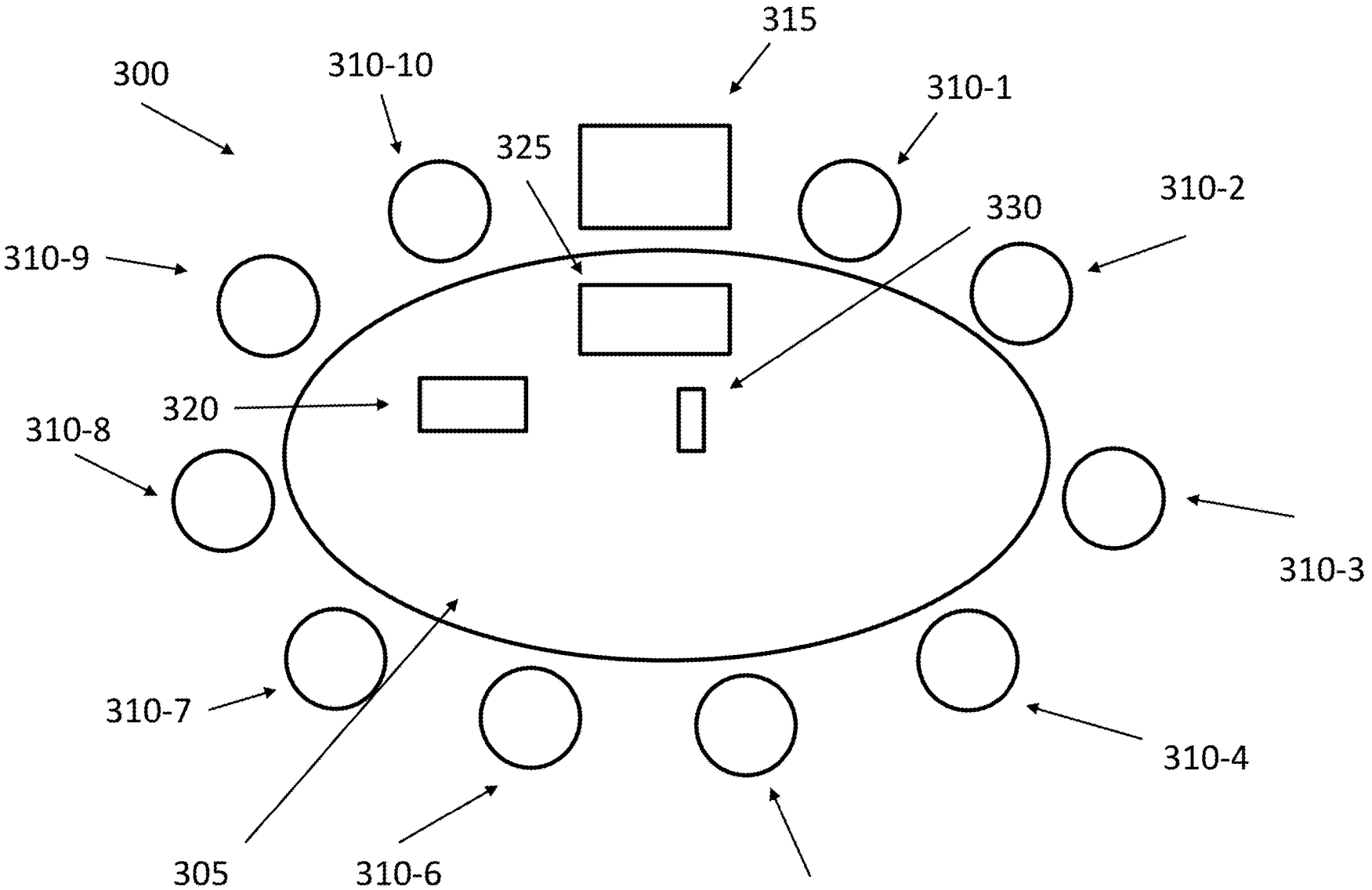
FIG. 3 illustrates a system for facilitating a live game according to the embodiments of the present invention.

FIG. 3 shows a system 300 according to the embodiments of the present invention. The system 300 comprises a poker table 305 having ten player positions 310-1 through 310-10 and a dealer position 315, an automatic card shuffler 320 integrated into said poker table 305 and a chip rack 325, containing gaming chips, integrated into said poker table 305 and a standard deck of playing cards 330. The standard deck of playing cards includes 52 playing cards comprising 13 cards ranked 2-10, Jack, Queen, King and Ace of four suits, namely Spades, Clubs, Hearts and Diamonds. The system 300 further includes the dealer being instructed to: (i) once small and large blinds are placed, deal each player one or more hole cards; (ii) bury said hole cards from each player electing to fold; (iii) accept a fixed bet from each player electing to participate in the hand; (iv) reveal one or more community cards; (v) conduct a betting round; (vi) repeat steps (iv) and (v) until all community cards have been revealed; (vii) determine a winning hand and (viii) award a pot to a player holding said winning hand.

Figure 4:
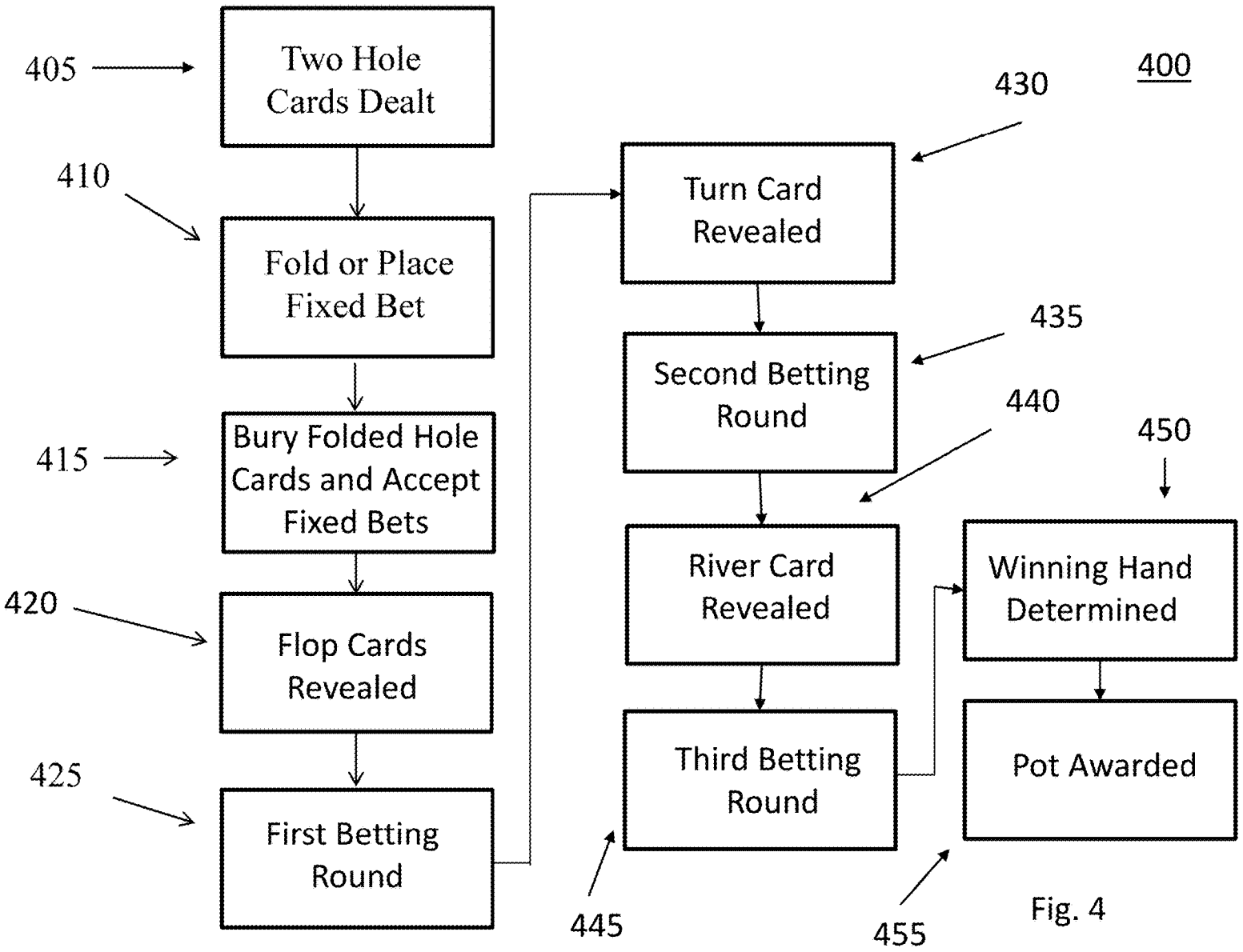
FIG. 4 illustrates a flow chart detailing one live method of conducting a game according to the embodiments of the present invention.

FIG. 4 shows a flow chart 400 detailing one live method of conducting a Texas Hold'em game utilizing the system 300. Once small and large blinds are placed, at 405, a dealer deals each player two-hole cards. The dealing of hole cards is one at a time and begins with the small blind player (i.e., player to the immediate left of the designated dealer). At 410, each player elects to fold or place a fixed bet. In one embodiment, the fixed bet is 3 times the amount of the big blind. For example, in a no-limit $5/$10 game, the fixed bet would be $30. Those skilled in the art will recognize that the fixed bet may be more or less than 3 times the big blind or unrelated to the big blind. For example, in a limit $5/$10 game, the fixed bet may be 2 times the big blind. At 415, the dealer collects and buries the hole cards of players electing to fold their hands and places the fixed bets from players electing to play their hands into the pot. At 420, the dealer reveals the three flop cards. At 425, a first betting round occurs during which remaining players may check, bet/raise and/or fold. At 430, the dealer reveals the turn card. At 435, a second betting round occurs during which remaining players may check, bet/raise and/or fold. At 440, the dealer reveals the river card. At 445, a third betting round occurs during which remaining players may check, bet/raise and/or fold. At 450, the dealer determines which remaining player holds the winning hand. At 455, the player holding the winning hand is awarded the pot (minus any house rake).

Figure 5:
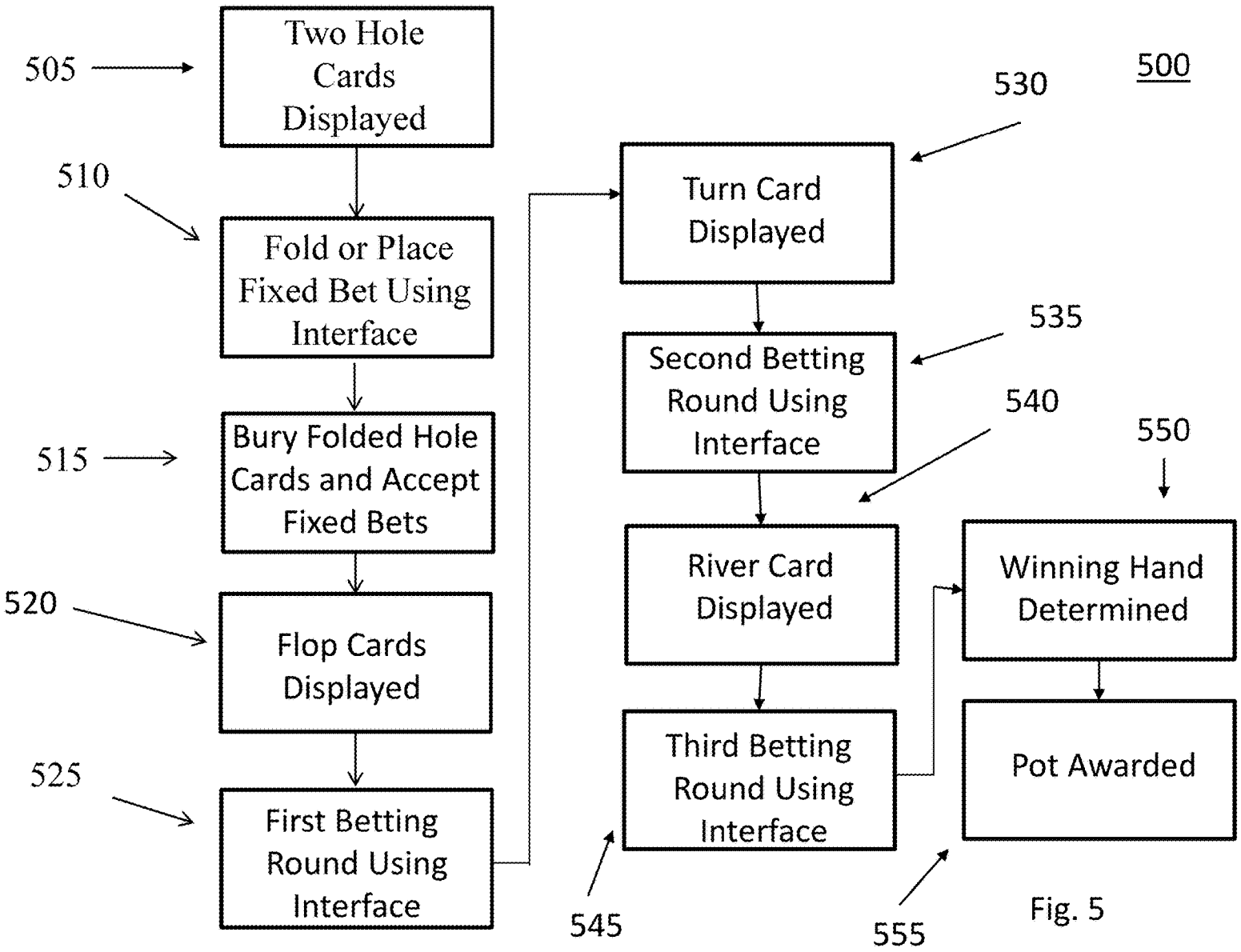
FIG. 5 illustrates a flow chart detailing one online method of conducting a game according to the embodiments of the present invention.

FIG. 5 shows a flow chart 500 detailing one online method of conducting a Texas Hold'em game utilizing the system 300. Once small and large blinds are placed, at 505, a processor running executable instructions causes each player to be dealt two hole cards viewable on a gaming device screen. At 510, each player uses a gaming device interface to fold or place a fixed bet. At 515, the processor removes the hole cards of players electing to fold their hands and credits a digital pot in the amount of the fixed bets from players electing to play their hands. At 520, the processer causes three flop cards to be displayed. At 525, a first betting round occurs during which remaining players may check, bet/raise and/or fold using a gaming device interface. At 530, the processor the turn card to be displayed. At 535, a second betting round occurs during which remaining players may check, bet/raise and/or fold using a gaming device interface. At 540, the processor causes the river card to be displayed. At 545, a third betting round occurs during which remaining players may check, bet/raise and/or fold using a gaming device interface. At 550, the processor determines which remaining player holds the winning hand. At 555, the processor credits, by an amount of the pot (minus any rake), the account of the player holding the winning hand.

Incorporating a pre-flop fold or fixed bet option encourages more players to stay in the hand to see the flop cards. It also eliminates the ability of aggressive and/or well-funded players to systematically make large pre-flop bets forcing out many players. Ultimately, the more players that stay in the hand longer, the larger the pots become. Larger pots benefit players and the house which derives it money from taking a percentage of each pot.

Although the invention has been described in detail with reference to several embodiments, additional variations and modifications exist within the scope and spirit of the invention as described and defined in the following claims.

I claim:

1. A game system comprising:

a poker table having ten or more player positions and a dealer position;

an automatic card shuffler integrated into said poker table;

a chip rack, containing gaming chips, integrated into said poker table;

a standard deck of playing cards including 52 playing cards comprising 13 cards ranked 2-10, Jack, Queen, King and Ace of four suits, namely Spades, Clubs, Hearts and Diamonds; and a dealer being instructed to: (i) deal each player one or more hole cards; (ii) discard said hole cards from each player electing to fold; (iii) accept a fixed bet from each player electing to participate in the hand; (iv) reveal one or more community cards; (v) conduct a betting round; (vi) repeat steps (iv) and (v) until all community cards have been revealed; (vii) determine a winning hand and (viii) award a pot to a player holding said winning hand.

2. The game system of claim 1 wherein said dealer if further instructed to: deal each player two hole cards during step (i).

3. The game system of claim 1 wherein said dealer is further instructed to: (a) reveal three community cards; (b) conduct a first betting round; (c) reveal a fourth community card; (d) conduct a second betting round; (e) reveal a fifth and final community card; and (f) conduct a third and final betting round during steps (iv), (v) and (vi).

4. An electronic game system comprising:

a game server, having at least one processor, running a poker game program, said game server accessible via multiple remote gaming devices; and wherein said processor is configured to run executable instructions to:

(i) display on each player's gaming device one or more hole cards; (ii) removing said hole cards from each player electing to fold; (iii) accepting a fixed bet from each player electing to participate in the hand; (iv) displaying on each player's gaming device one or more community cards; (v) conduct a betting round whereby bets are placed via said gaming devices; (vi) repeat steps (iv) and (v) until all community cards have been displayed; (vii) determine a winning hand and (viii) award a pot, via a digital credit, to a player holding said winning hand.

5. The electronic game system of claim 4 wherein said processor is further configured to run executable instructions to: display each player two hole cards during step (i).

6. The game system of claim 4 wherein said processor is further configured to run executable instructions to: (a) reveal three community cards; (b) conduct a first betting round; (c) reveal a fourth community card; (d) conduct a second betting round; (e) reveal a fifth and final community card; and (f) conduct a third and final betting round during steps (iv), (v) and (vi).

* * * * *